US007927387B1

(12) United States Patent
DiFilippo

(10) Patent No.: US 7,927,387 B1
(45) Date of Patent: Apr. 19, 2011

(54) COMPREHENSIVE GASOLINE AND DIESEL FUEL ADDITIVE

(76) Inventor: AmoDio A. DiFilippo, Manlius, NY (US)

( * ) Notice: Subject to any disclaimer, the term of this patent is extended or adjusted under 35 U.S.C. 154(b) by 387 days.

(21) Appl. No.: 12/207,478

(22) Filed: Sep. 9, 2008

Related U.S. Application Data

(60) Provisional application No. 60/987,200, filed on Nov. 12, 2007.

(51) Int. Cl.
*C10L 1/18* (2006.01)
*C10L 1/22* (2006.01)

(52) U.S. Cl. ..... 44/439; 44/389; 44/418; 44/434; 44/437; 44/438; 44/451

(58) Field of Classification Search ..... 44/437, 44/438, 439, 451, 389, 418, 434
See application file for complete search history.

(56) References Cited

U.S. PATENT DOCUMENTS

| | | | | |
|---|---|---|---|---|
| 4,973,336 | A * | 11/1990 | Gheysens | 44/331 |
| 2004/0060229 | A1 * | 4/2004 | Todd et al. | 44/603 |
| 2009/0107035 | A1 * | 4/2009 | Leung | 44/389 |
| 2010/0269404 | A1 * | 10/2010 | Sloan | 44/370 |

* cited by examiner

*Primary Examiner* — Cephia D Toomer
(74) *Attorney, Agent, or Firm* — David L. Nocilly; George R. McGuire; Bond Schoeneck & King, PLLC

(57) ABSTRACT

A comprehensive fuel additive for gasoline, diesel and ultra low sulfur diesel fuels intended to improve engine combustion efficiency, improve diesel fuel cetane levels, improve diesel and ultra low sulfur diesel fuel lubricity, reduce engine component friction, reduce engine deposit buildup, reduce gasoline and diesel fuel bio-contamination and reduce pollutant exhaust emissions produced by gasoline and diesel fuel powered internal combustion engines. The present invention further provides a fuel additive that does not increase the sulfur level of diesel fuel beyond 15 ppm.

20 Claims, No Drawings

COMPREHENSIVE GASOLINE AND DIESEL FUEL ADDITIVE

CROSS-REFERENCE TO RELATED APPLICATIONS

The present application claims priority to U.S. Provisional Application No. 60/987,200, filed on Nov. 12, 2007

BACKGROUND OF THE INVENTION

The present invention relates to the use of comprehensive fuel additives for gasoline and diesel fuels intended to improve engine combustion efficiency, improve diesel fuel cetane levels, improve diesel and ultra low sulfur diesel fuel lubricity, reduce engine component friction, reduce engine deposit formation, reduce gasoline and diesel fuel bio-contamination and reduce pollutant exhaust emissions produced by gasoline and diesel fuel powered internal combustion engines. The present invention further relates to the use of fuel additives that do not increase the sulfur level of ultra low sulfur diesel fuel beyond 15 ppm (parts per million).

SUMMARY OF THE INVENTION

The present invention provides a comprehensive fuel additive for gasoline, diesel and ultra low sulfur diesel fuels intended to improve engine combustion efficiency, improve diesel fuel cetane levels, improve diesel and ultra low sulfur diesel fuel lubricity, reduce engine component friction, reduce engine deposit buildup, reduce gasoline and diesel fuel bio-contamination and reduce pollutant exhaust emissions produced by gasoline and diesel fuel powered internal combustion engines. The present invention further provides a fuel additive that does not increase the sulfur level of ultra low sulfur diesel fuel beyond 15 ppm.

The comprehensive fuel additive of present invention comprises the following compounds:

2-Ethylhexanol $CH_3(CH_2)_3CH(CH_2CH_3)CH_2OH$, with an effective range quantity being 1.8127%-22.5% by volume of the total volume of the said additive and a preferred "best mode" range for typical applications being 7.6312%-11.64% by volume of the total volume of the said additive. In applications of extremely high cetane level (≧CN55) diesel fuels 2-Ethylhexanol can be omitted from the fuel additive composition.

2-Propanone $CH_3COCH_3$, with an effective range quantity being 50%-80% by volume of the total volume of the said additive and a preferred "best mode" range for typical applications being a quantity of 75%-80% by volume of the total volume of the said additive.

Ethoxylated Amine Based Friction/Lubricity Modifier R—$(OCH_2CH_2)$n-NH (Where 'R' represents said Amine, and 'n' represents the number of oxyethylene groups) or alternatively an Ester and Amide Based Friction/Lubricity Modifier. The effective range quantity of the friction/lubricity modifier being 1.56%-7.68% by volume of the total volume of the said additive and a preferred "best mode" range for typical applications being 2.86%-3.84% by volume of the total volume of the said additive.

Heavy Aromatic Naphtha, CAS No. 64742-94-5, with an effective range quantity being 0.48%-5.7408% by volume of the total volume of the said additive and a preferred "best mode" range for typical applications being 0.768%-2.612% by volume of the total volume of the said additive.

1,2,4-Trimethylbenzene $C_6H_5(CH_3)_3$ or alternatively Trimethylbenzene $C_6H_3(CH_3)_3$. The effective range quantity being 0.2352%-0.9408% by volume of the total volume of the said additive and a preferred "best mode" range for typical applications being 0.384%-0.4312% by volume of the total volume of the said additive.

Naphthalene $C_{10}H_8$, with an effective range quantity being 0.1344%-0.768% by volume of the total volume of the said additive and a preferred "best mode" range for typical applications being 0.2464%-0.384% by volume of the total volume of the said additive.

Hydrotreated Light Petroleum Distillates, CAS No. 64742-47-8 as a suitable carrier diluent for diesel fuel applications with an effective range quantity being 1.44%-4.608% by volume of the total volume of the said additive and a preferred "best mode" quantity for typical diesel fuel applications being 2.304% by volume of the total volume of the said additive.

Hydrotreated Middle Naphthenic Petroleum Distillates, CAS No. 64742-46-7 with an effective range quantity being 0%-22.28% by volume of the total volume of the said additive and a preferred "best mode" range for typical applications being 0%-10.78% by volume of the total volume of the said additive.

Aliphatic Aldehyde Aroma Compound with an effective range quantity being 0.34%-0.70% by volume of the total volume of the said additive and a preferred "best mode" range for typical applications being 0.42%-0.68% by volume of the total volume of the said additive.

Those skilled in the present art will understand that under appropriate circumstances, such as cost, availability, convenience, and the precise needs of the fuel to be treated, the volume percent of the disclosed componants will be varied within the stated limits to meet the unique needs of the local gasoline and/or diesel fuel.

Preferably the comprehensive fuel additive of the present invention is added to gasoline in a ratio of between 2.5 to 4 liquid ounces of fuel additive to 10 gallons of gasoline or diesel fuel. Upon reading of the specification, those skilled in the present art will understand that under appropriate circumstances, such as cost, availability, convenience and precise needs of the fuel to be treated, etc., treatment ratios can be modified. One such example would be an intermittent vehicle treatment rate of every fifth tank of fuel.

In general, the comprehensive fuel additive composition of the present invention is prepared using conventional techniques. The comprehensive fuel additive composition of the present invention is prepared by carefully blending the disclosed liquid components until a uniform solution is obtained. Care should be taken to prevent accidental ignition of the composition due to its high flammability.

Further aspects of the invention will become apparent from consideration of the provided description. Those skilled in the present art will understand and appreciate the existence of variations, combinations and equivalents of the provided description and therefore understand that other embodiments of the invention are possible and that the details of the invention can be modified in a number of respects, all without departing from the scope and spirit of the invention. The invention should therefore not be limited by the provided description, method, and examples. The provided description, method, and examples are to be regarded as illustrative in nature rather than restrictive.

DETAILED DESCRIPTION

The present invention provides a comprehensive fuel additive for gasoline, diesel and ultra low sulfur diesel fuels intended to improve engine combustion efficiency, improve diesel fuel cetane levels, improve diesel and ultra low sulfur diesel fuel lubricity, reduce engine component friction, reduce engine deposit buildup, reduce gasoline and diesel fuel bio-contamination and reduce pollutant exhaust emissions produced by gasoline and diesel fuel powered internal combustion engines. The present invention further provides a fuel additive that does not increase the sulfur level of diesel fuel beyond 15 ppm (parts per million).

Gasoline is a complex combination of relatively volatile hydrocarbons (typically C4 to C12) with or without small quantities of additives, blended to form a fuel suitable for use in spark ignition internal combustion engines. "Motor gasoline", as defined in the American Society for Testing and Materials ASTM Specification D 4814 or Federal Specification VV-G-1690C, is characterized as having a boiling range of 122 degrees F. to 158 degrees F. at the 10-percent recovery point to 365 degrees F. to 374 degrees F. at the 90-percent recovery point. Motor gasoline includes conventional gasoline, reformulated gasoline, oxygenated gasoline including gasohol, and other finished gasoline. For the purpose of the present invention the term "gasoline" refers to any liquid fuel that can be used to operate a spark ignition internal combustion engine.

Diesel fuel is a complex combination of relatively volatile hydrocarbons (typically C12 to C30) with or without small quantities of additives and is typically characterized by having a boiling range of approximately 340 degrees F. to 650 degrees F. Diesel fuel is refined into several sub-categories or grades which include:

No. 1 Diesel Fuel: A light distillate fuel oil that has a distillation temperature of 550 degrees F. at the 90-percent recovery point and meets the specifications defined in ASTM D 975. It is used in high speed diesel engines generally operated under frequent speed and load changes.

No. 2 Diesel Fuel: A distillate fuel oil that has a distillation temperature of 640 degrees F. at the 90-percent recovery point and meets the specifications defined in ASTM D 975. It is used in high-speed diesel engines that are generally operated under uniform speed and load conditions.

No. 4 Diesel Fuel: A distillate fuel oil made by blending distillate fuel oil and residual fuel oil stocks. It conforms to ASTM Specification D 396 or Federal Specification VV-F-815C and is used extensively in industrial plants and in commercial burner installations that are not equipped with preheating facilities. It also includes No. 4 diesel fuel used for low and medium speed diesel engines and conforms to ASTM Specification D 975.

Ultra Low Sulfur Diesel Fuel: Defined by the United States Environmental Protection Agency (EPA) as United States diesel fuel with a sulfur content not exceeding 15 ppm (parts per million) as defined in the Code of Federal Regulations 40 CFR Part 80.

For the purpose of the present invention the term "diesel fuel" refers to any liquid fuel that can be used to operate a compression ignition internal combustion engine.

Combustion

A major difference between gasoline and diesel internal combustion engines is the fuel injection and ignition process. A gasoline internal combustion engine intakes a mixture of fuel and air, compresses it, then ignites the mixture with an electric spark. A diesel internal combustion engine intakes air, compresses it, then injects fuel into the compressed air. The heat of the compressed air ignites the fuel spontaneously (autoignition). When gasoline or diesel fuel is injected into a cylinder under high pressure, it atomizes into small droplets that mix with hot air in the combustion chamber and begins to vaporize as it moves away from the injection nozzle. As the fuel vaporizes into the hot air, it begins to react with the oxygen molecules (oxidation) in the hot air. This reaction of fuel and oxygen is necessary for combustion. As more fuel vaporizes and mixes with air, the number and rate of the oxidation reactions increase until the end of the ignition delay period, when ignition occurs. The ignition of fuel occurs at many locations independently and combustion propagates very rapidly in regions which have fuel-air ratios in the combustible range. In diesel engines this initial combustion after ignition is known as the "pre-mixed combustion phase". This pre-mixed combustion phase consumes only 5% to 10% of the fuel used by the diesel engine at typical full-load operation. At the end of the pre-mixed combustion phase, most of the diesel fuel has yet to be injected or is still in a region that is too rich to burn. Injection continues as fuel continues to vaporize and mix with air, aided by the heat release and turbulence generated by the initial combustion. This quickly generates more gas with the required fuel-air ratio and combustion continues. This phase of diesel combustion is known as the "diffusion controlled" or "mixing controlled" phase and, ideally, consumes the remaining diesel fuel that will be burned. Modern analysis using the KIVA3 computational fluid dynamics (CFD) code and advanced visualization techniques can be used to better understand this process. Diesel fuel that is injected directly into the combustion chamber is at a pressure of approximately 300-1500 atm and is injected through a multi-hole nozzle with several orifices approximately 0.15-0.35 mm in diameter. For diesel combustion applications, the mechanisms of spray atomization and mixing are of primary importance. The conversion of the high speed liquid columns injected into air form a multitude of individual fluid drops approximately 10-100 μm in diameter. This occurs via a multi-stage process, including the fluid mechanics instabilities (Rayleigh-Taylor instability), followed by their nonlinear stage, appearance of flat fluid sheets, annular sheets, conical sheets, jets, etc. Gasoline and diesel fuel consists of a complex combination of various hydrocarbons including but not limited to: Parrafins or Alkanes such as n-butane, n-pentane, n-hexane, n-heptane, 2-methylbutane, 2,2-dimethylpropane, 2,2-dimethylbutane, 2,2-dimethylpentane, 2,2,3-trimethylbutane, 2,2,4-trimethylpentane; Alkenes or Olefins such as 1-pentene, 2-methyl-2-butene, 3-methyl-2-pentene, 4,4-trimethyl-1-pentene; Cycloalkanes or Naphthenes such as cyclopentane, methylcyclopentane, cyclohexane, 1,2-dimethylcyclohexane, 4-dimethylcyclohexane; Aromatics such as benzene, toluene or methylbenzene, m-xylene or 1,3-dimethylbenzene, ethylbenzene, propylbenzene, isopropylbenzene.

These hydrocarbons have different chemical and physical properties which affect how they burn. When fuel is sprayed into a gasoline or diesel engine combustion chamber these hydrocarbons form droplets of varying size that vaporize and burn at different rates and temperatures. The smaller droplets vaporize more rapidly due in part to their higher surface area per volume and concentrate near the spark plug (gasoline engines), followed by the larger droplets that then vaporize. During ignition (in the case of gasoline internal combustion engines) or autoignition (in the case of diesel internal combustion engines) the vaporized shorter hydrocarbon molecules burn followed by the vaporized longer hydrocarbon molecules. Gasoline and diesel internal combustion engines convert fuel from a liquid state to a vapor because only vaporized fuel will burn. By using both a mechanical high pressure injection process and the heat generated during compression, the fuel is converted from a liquid to a vapor. This vaporization process typically converts the majority of the fuel injected from a liquid to a vapor during each cycle. During this vaporization process, however, a relatively small amount of fuel resists vaporization and forms liquid films in the induction channel and on the cylinder walls. Also, after the vaporization process and during ignition delay, a modest amount of fuel molecules recombine into liquid fuel fragments in the combustion chamber. These unvaporized fuel fragments are not burned in the combustion chamber but are relegated to the catalytic process and burned as unusable energy via the catalytic convertor. The amount of these unburned fuel fragments occurring during each cycle is modest although become relevent when one considers that 1,200 to 6,000 engine cycles (revolutions) can occur each minute. The quantitative total of these un-vaporized/un-burned fuel fragments are in part responsible for reduced fuel economy and to a lesser extent (due to the catalytic process) hydrocarbon (HO) and carbon monoxide (CO) emissions. The majority of fuel fragments that resist vaporization and the fuel molecules that re-combine during ignition delay are dominated by the longer hydrocarbon groups. This is in part due to the fact that these longer hydrocarbon chains are less volatile, and when in a liquid state have a relatively lower vapor pressure and higher enthalpy of vaporization than that of the shorter hydrocarbons. This results in a greater resistance to vaporization as well as a greater propensity for the vaporized longer hydrocarbon chains to undergo the phase change from a vapor back to a liquid.

Pollutant Exhaust Emissions

When hydrocarbon fuel is burned in an internal combustion engine, chemical byproducts of the combustion process form pollutant exhaust emissions.

Nitrogen Oxides ($NO_x$): Nitrogen monoxide (NO) and nitrogen oxide ($NO_2$) are collectively known as nitrogen oxides ($NO_x$). These pollutants tend to be formed in the stoichiometric and slightly lean regions of the combustion chamber where there is excess oxygen and the temperature is high. Outside of these regions, either there is insufficient oxygen to form ($NO_x$) or temperatures are too low for the reactions to occur quickly enough.

Hydrocarbons (HC): Hydrocarbon emissions can be either unburned or partially burned fuel molecules, and can come from several sources. At ignition, some of the vaporized fuel will already be in a region that is too lean for it to burn; and unless it burns later in the cycle, this fuel will be emitted unburned. The cylinder walls and "crevice" regions around the top of the piston edge and above the rings are much cooler than the combustion gases and tend to quench flames as they encroach. This, fuel at the cylinder wall can contribute to (HC) emissions. Fuel that does not vaporize and burn is responsible for white smoke typically seen under this condition. A small amount of fuel can also dissolve into the thin film of lubricating oil on the cylinder wall, then be removed from the oil in the expansion stroke, and then emitted unburned. Compared to gasoline internal combustion engines, diesel internal combustion engines operate at an overall lean fuel-air ratio and therefore tend to emit lower levels of hydrocarbon emissions.

Carbon Monoxide: Carbon monoxide (CO) is a result of incomplete combustion and is formed mostly in those regions of the cylinder that are too fuel-rich to support complete combustion, although it may also originate at the lean limit of combustible fuel-air mixtures. Because diesel internal combustion engines typically have excess oxygen, gasoline internal combustion engines generally emit higher amounts of carbon monoxide (CO) emissions than do diesel internal combustion engines.

Carbon Dioxide: ($CO_2$): If temperatures are high enough, the carbon monoxide (CO) formed as a result of incomplete combustion can further react with oxygen to form carbon dioxide ($CO_2$).

Sulphur (S): Sulfur impurities in fuel oxidize to form sulphur dioxide ($SO_2$) with some sulfur being further oxidized to sulphur trioxide ($SO_3$). Due to United States federal regulations, gasoline and diesel fuel sulfur contents have been significantly reduced.

Particulate Matter (PM10 and PM2.5): During the combustion process some of the fuel droplets may never vaporize, and thus, never burn. The fuel however doesn't remain unchanged; the high temperatures in the cylinder cause it to decompose. Later, these droplets may be partly or completely burned in the turbulent flame. If they are not completely burned, they will be emitted as droplets of heavy liquid or particles of carbonaceous material. The conversion of fuel to particulates is most likely to occur when the last bit of fuel is injected in a cycle, or when the engine is being operated at high load and high speed. At higher engine speeds and loads, the total amount of fuel injected increases and the time available for combustion decreases. Also, some of the lubricating oil on the cylinder wall is partially burned and contributes to particulate emissions. Also a poorly operating or mis-timed fuel injection system can substantially increase particulate emissions. Particulate matter emissions in diesel engines are mainly the result of the heterogeneous nature of diesel combustion. When fuel is injected into hot compressed air in the cylinder, regions develop that are fuel-rich and oxygen deficient. Because of the high temperature and pressure in the cylinder, the fuel may start to break down before it has a chance to mix with air and burn normally. These high temperature cracking reactions (pyrolysis) lead to the formation of carbonaceous soot particles. Unburned or partially burned fuel can condense on these particles, increasing their size and mass. These particles can stick together (agglomerate) to create visible smoke. Diesel particulate matter and nitrogen oxide ($NO_x$) emissions are linked by the nature of diesel combustion.

Efforts to reduce particulate matter by increasing combustion efficiency lead to higher combustion temperatures and, thus, higher nitrogen oxide ($NO_x$) emissions. Lowering nitrogen oxide ($NO_x$) formation by lowering combustion temperature leads to less complete combustion and, thus, higher particulate matter emissions. PM10 is particulate matter with a particle size less than or equal to 10 microns (0.0004 inch) and PM2.5 has a particle size less than or equal to 2.5 microns (0.0001 inch). The EPA estimates that fugitive dust from roads accounts for about two-thirds of the total PM10 nationwide. Less than 2% of PM10 is attributed to on-road and off-road engines, but the percentage is higher in urban areas where there is less dust and more combustion sources. Particulates from diesel engines include primary carbon particles and secondary sulfate and nitrate aerosols formed from SO2 and NOx.

Without being limited to any particular theory of operation, the effectiveness of the present invention is believed to be related to several mechanisms of action. The combination of these mechanisms (as opposed to the results of any one mechanism alone) may be responsible for the fuel additive composition of the present invention's marked results. In part, the effectiveness of the present invention is believed to be related to enhanced combustion via an increase in vapor pressure (at typical combustion temperatures) of the longer hydrocarbon species in treated fuel resulting in an increase in fuel vaporization of those species.

When a liquid is heated to its boiling point, energy (in the form of heat) is added to the liquid, resulting in an increase in the temperature of the liquid. Once the liquid reaches its boiling point however, the further addition of heat does not cause a further increase in temperature. The energy that is added to the liquid is used to overcome the intermolecular forces of attraction (van der Waals force) between the molecules of the liquid, causing a phase change, converting the liquid to a vapor state. Enthalpy of Vaporization expressed as ($\Delta H_{vap}$), is the amount of energy (typically measured in units of $10^3$ J/kg) required to overcome the intermolecular forces of attraction and repulsion between the molecules of a liquid (measured at the liquid's normal boiling point), bringing the liquid to a vapor state.

Enthalpy of vaporization is the difference in heat content between coexisting liquid and vapor expressed as:

$$\Delta H_{vap}=H_V-H_L$$

Vapor pressure ($P_{vap}$), (typically measured in units of psi) is the pressure of a vapor in equilibrium with its non-vapor phases.

The vapor pressure of a substance is an intrinsic physical property that plays a crucial role in determining a liquid's tendency to vaporize.

If v is the volume which contains w grams of the vaporized material having a molecular weight M, and if $P_{vap}$ is the pressure of the vapor in equilibrium at temperature T, and R is the gas constant, then the vapor pressure $P_{vap}$ is calculated by:

$$Pvap = \left(\frac{w}{M}\right)\left(\frac{RT}{v}\right)$$

The vapor pressure of a liquid increases significantly with an increase in temperature.

During combustion temperatures, high vapor pressure liquids increase in ability to vaporize. The variation of vapor pressure as a function of temperature is given by the Clausius-Clapeyron equation:

$$\ln Pvap = \frac{-\Delta Hvap}{RT} + \frac{\Delta Svap}{R}$$

A plot of In $P_{vap}$ vs. I/T should be linear with slope related to $\Delta H_{vap}$ and intercept to $\Delta S_{vap}$.

therefore:

$$\text{Slope} = \frac{-\Delta Hvap}{R}$$

and:

$$\text{Intercept} = \frac{\Delta Svap}{R}$$

The vapor pressure of a liquid is principally determined by the magnitude of the liquid's intermolecular forces. The advent of quantum mechanics has led to an in-depth understanding of intermolecular forces. Intermolecular forces are forces between molecules that include the following:

Hydrogen bonding: (approx energy=10-40 kJ) Special case of dipole-dipole reaction when there is a H bonded to a N, O, or F. Examples: water, acetic acid, 2-Propanone in water.

Ion-dipole force: (approx energy=5-50 kJ) Interaction of an ion (cation or anion) with a polar molecule. Examples: dissolving any ionic compound in water. NOTE: A polar molecule is a neutral molecule that possesses a dipole moment, that is, a separation of partial positive (denoted by δ+) and partial negative (denoted by δ−) charges on opposite sides of a molecule. Polar molecules almost always have at least one electronegative atom like O, N, F, Cl.

Dipole-dipole force: (approx energy=3-4 kJ) The electrostatic attractive force between two neutral molecules that have dipole moments (polar molecules). Examples: 2-Propanone in 2-Propanone (CH2-O), triethyl amine in 2-Propanone.

London dispersion forces: (approx energy=1-10 kJ) A temporary dipole moment on one atom can polarize (align) the electrons on a neighboring atom to create two instantaneous electric dipole moments. These are the very weak interactions that hold two nonpolar molecules together.

All forces at the molecular level are electrical in origin, and can be fundamentally understood in terms of Coulomb's Law. The magnitude of the intermolecular force (F) can be expressed by Coulomb's law with the equation as follows:

$$F = k\frac{q1q2}{d}$$

where q is the charge, d is the distance between the charges, and k is a proportionality constant.

Liquids with high vapor pressures are a result of weak intermolecular forces. Among the weakest of these weak intermolecular forces are dipole-dipole interactions. The strength of the interaction depends on the distance and relative orientation of the dipoles.

Dipole Moment is the measure for the polarity of a polar covalent bond. It is defined as the product magnitude of charge on the atoms and the distance between the two bonded atoms. Its common unit is the "debye" abbreviated (D) or coulomb-meter abbreviated (Cm). 1 Cm=2.9979 $10^{29}$ debye. Dipole-dipole intermolecular forces are weaker for molecules with smaller dipole moments.

Typical methods of improving combustion vaporization at the refinery or downstream level have to date been the use of volatile componants or surfactants which increase overall vapor pressure of the fuel or lower the fuel's surface tension. Increasing the overall vapor pressure of fuel however poses a danger due to accidental ignition as well as an environmental risk due to the increase of evaporative VOC (volatile organic compound) emissions. Due to the chemical and physical properties of gasoline and diesel fuel the effectiveness of surfactants in increasing combustion vaporization have been limited. Fuel volatility regulations and fluctuating seasonal requirements make gasoline production and distribution a complex process. Refiners producing gasoline and diesel fuel routinely attempt to adjust the vaporization ability of the fuel based on the season, due to vapor pressure's increase with temperature. With respect to fuel economy and pollutant exhaust emissions, a fuel with an optimal vapor pressure for one engine may not be optimal for another engine. Gasoline and diesel fuel suppliers are unable to provide an infinite variety of fuel variations for each engine's unique specifications which would optimize each engine's fuel economy, pollutant exhaust emmissions and power output; therefore commercially available third party fuel additives are a viable solution.

The United States Environmental Protection Agency (EPA) chose a vapor pressure of 0.1 mmHg as the threshold for determining whether or not a volatile organic compound should be considered to be a precursor to the formation of ozone (O3). The EPA determined that if an organic compound had a vapor pressure equal to, or greater than 0.1 mmHg, it should be considered to be a VOC (volatile organic compound), where "VOC" implies that it contributes to the formation of ozone (O3). Certain stable volatile organic compounds have been demonstrated however to not form ozone (O3) with any ease. The EPA confirmed that these compounds have a negligible tendency to react with nitrogen oxides (NOx) in the presence of sunlight to form ozone (O3). Therefore, the EPA determined that such compounds were "exempt". They do not form ozone easily and are not considered a threat to ozone (O3) formation. An additive componant that is EPA classified as VOC "exempt" [40 CFR 51.100(s)(1)], with a relatively weak dipole-dipole bond (i.e. CH3-O) resulting in a relatively high vapor pressure (compared to that of the longer hydrocarbon species found in untreated fuel), can aid in the vaporization of the lower volatility longer hydrocarbon chains during combustion, enhancing complete combustion without markedly increasing the overall volatility characteristics of the fuel itself. As a result of enhanced combustion, unburned residual waste is reduced, causing the engine to operate cleaner and more efficiently while reducing unwanted harmful emissions.

The comprehensive fuel additive composition of the present invention comprises a component with a relatively high vapor pressure and relatively low dipole moment, sufficient to effectively enhance combustion namely 2-Propanone $CH_3COCH_3$ being an organic aliphatic ketone with an effective range quantity being 50%-80% by volume of the total volume of the said additive and a preferred best mode range for typical applications being a quantity of 75%-80% by volume of the total volume of the said additive.

Cetane Number and Ignition Delay

Diesel engines rely on compression ignition of the fuel. The source of ignition energy is the high temperature, high pressure air present in the combustion chamber towards the end of the compression stroke. To achieve these high temperatures and pressures, diesel engines typically have far higher compression ratios than do gasoline engines. Upon injection into the combustion chamber, fuel must quickly mix with air to form a flammable which must ignite. Since there is normally no additional means for ignition (such as the spark plug in gasoline engines), the fuel must self-ignite (autoignition). This process takes time and is influenced greatly by the engine combustion system and by fuel properties. Diesel engines use the heat developed by compressing a charge of air to ignite the fuel injected into the engine cylinder after the air is compressed. More specifically, the air is first compressed, then fuel is injected into the cylinder; as fuel contacts the heated air, it vaporizes and finally begins to burn as the self-ignition temperature is reached. Additional fuel is injected during the compression stroke and this fuel burns almost instantaneously, once the initial flame has been established. A period of time elapses between the beginning of fuel injection and the appearance of a flame in the cylinder. This period is known as ignition delay and is a major factor in regards to the performance of diesel fuel.

Cetane Number is a measure of how readily the fuel starts to burn (autoignition) under diesel engine conditions. A fuel with a high cetane number starts to burn shortly after it is injected into the cylinder and therefore has a short ignition delay period. Conversely, a fuel with a low cetane number resists autoignition and has a longer ignition delay period. If the ignition delay is too long, the fuel will accumulate in the cylinder until it reaches ignition conditions and then will burn rapidly, causing a sudden pressure and temperature increase resulting in engine knocking and a decrease in engine efficiency. Cetane number/ignition delay varies systematically with hydrocarbon structure. A reduction in ignition delay can be obtained by varying the chemical nature of the injected fuel. Straight chain paraffinic hydrocarbons cause less ignition delay, while branched chain paraffins and cyclic (including aromatic) hydrocarbons cause longer ignition delays. Aromatic hydrocarbons are relatively compact and unreactive molecules compared to the other prime constituents of diesel fuel. Consequently, aromatics tend to resist ignition and be low in cetane number. Therefore, normal paraffins have high cetane numbers that increase with molecular weight.

Isoparaffins have a wide range of cetane numbers, from about 10 to 80. Molecules with many short side chains have low cetane numbers; whereas those with one side chain of four or more carbons have high cetane numbers. Naphthenes generally have cetane numbers from 40 to 70. Higher molecular weight molecules with one long side chain have high cetane numbers; lower molecular weight molecules with short side chains have low cetane numbers. Aromatics have cetane numbers ranging from 0 to 60. A molecule with a single aromatic ring with a long side chain will be in the upper part of this range; a molecule with a single ring with several short side chains will be in the lower part. Molecules with two or three aromatic rings fused together have cetane numbers below 20.

In the past many types of additives have been developed to raise the cetane number of diesel fuels. Such additives usually contain nitrogen or sulfur, both of which are known cetane improvers under certain circumstances. These additives however can add to nitrogen oxide (NOx) and Sulfur Oxide (SOx) emissions. (SOx) formation can also contaminate the engine's lubrication oil by forming sulfuric acid which breaks down various antiwear additives found in the oil. Certain thermally unstable chemical compounds when added to diesel fuel, decompose rapidly at combustion temperatures and promote the reactions that lead to higher molecular weight species which help initiate fuel combustion and thereby decrease ignition delay. The effectiveness of the present invention is also believed to be related to an overall sharp decrease in diesel fuel ignition delay thereby improving diesel fuel cetane levels. This in turn creates a more uniform combustion, under ideal temperature and pressure conditions. The comprehensive fuel additive composition of the present invention comprises a component sufficient to effectively reduce ignition delay namely 2-Ethylhexanol $CH_3(CH_2)_3CH(CH_2CH_3)CH_2OH$ being a branched chain aliphatic alcohol, with an effective range quantity being 1.8127%-22.5% by volume of the total volume of the said additive and a preferred "best mode" range for typical applications being 7.6312%-11.64% by volume of the total volume of the said additive. In applications of extremely high cetane diesel fuels (≧CN55) 2-Ethylhexanol $CH_3(CH_2)_3CH(CH_2CH_3)CH_2OH$ can be omitted from the fuel additive composition. At the volume percentages disclosed 2-Ethylhexanol $CH_3(CH_2)_3CH(C_2H_5)CH_2OH$ being an aliphatic alcohol also functions as an effective low temperature carrier solvent for the fuel additive composition.

Engine Component Friction

Friction is defined as the surface resistance to relative motion. It is the force that opposes the relative motion or tendency of such motion of two surfaces in contact. Gasoline and diesel internal combustion engines are not 100% efficient in converting the energy of the fuel into power to move a vehicle. Energy is lost through radiation, heating the exhaust, coolant, and through friction between moving parts. These frictional losses can account for up to 38% of the total energy in the fuel with nearly one half of this loss coming from the pistons, rings, and cylinder walls. Lubricity is the ability to reduce friction between solid surfaces in relative motion. Diesel internal combustion engines rely in part on fuel to lubricate certain moving parts of the fuel pump and fuel injectors. To avoid excessive wear, the fuel must have a minimum amount of lubricity. Ultra low sulfur diesel fuel requirements specify a 15 parts per million sulfur limit. The processing required to reduce sulfur also removes naturally occurring lubricity agents required to lubricate parts within the fuel injection system. To manage this change, the American Society for Testing and Materials (ASTM) adopted the lubricity specification defined in ASTM D975 for all diesel fuels. The ASTM D975 specification is based on the High Frequency Reciprocating Rig (HFRR) test (D 6079) and requires a wear scar no larger than 520 microns. The use of diesel fuels with poor lubricity can increase fuel pump and injector wear and at the extreme, cause catastrophic failure. Lubrication mechanisms are a combination of hydrodynamic lubrication and boundary lubrication. With hydrodynamic lubrication, a layer of liquid prevents contact between the opposing surfaces. For diesel fuel pumps and injectors, the liquid is the fuel itself. When high load and/or low speed has removed much of the liquid that provides hydrodynamic lubrication, boundary lubrication becomes critical, with small areas of the opposing surfaces in contact. Boundary lubricants are compounds that form a protective anti-wear layer by adhering to the solid surfaces. Fatty acids and esters contain a polar group that is attracted to metal surfaces, creating a thin surface film. The film acts as a boundary lubricant when metal surfaces come in contact.

The effectiveness of the present invention is also believed to be related to the reduction of mechanical friction. When combined with diesel fuel the fuel additive composition and diesel fuel mixture meets the American Society for Testing and Materials ASTM D975-04 lubricity performance requirements. The comprehensive fuel additive composition of the present invention comprises a component sufficient to effectively reduce engine component friction namely an Ethoxylated Amine Based Friction/Lubricity Modifier R—$(OCH_2CH_2)$n-NH (Where 'R' represents said Amine, and 'n' represents the number of oxyethylene groups) or alternatively an Ester and Amide Based Friction/Lubricity Modifier that does not increase the sulfur level of ultra low sulfur diesel fuel beyond 15 ppm (parts per million). The effective range quantity of the friction/lubricity modifier being 1.56%-7.68% by volume of the total volume of the said additive and a preferred "best mode" range for typical applications being 2.86%-3.84% by volume of the total volume of the said additive. Examples of suitable ethoxylated amines include but are not limited to tallow amine ethoxylate, stearyl amine ethoxylate, coco amine ethoxylate and oleyl amine ethoxylate. An example of a suitable commercially available ethoxylated amine based friction/lubricity modifier is (but is not limited to) Ultrazol 9525A.T.M. from The Lubrizol Corporation (Wickliffe, Ohio, USA). Examples of suitable esters include but are not limited to reaction products of saturated, unsaturated, mixed saturated and unsaturated mono-, di- and tri-carboxylic acids having from 12 to 72 carbon atoms with alcohols, glycols, polyglycols, and mixtures thereof. Specific examples of suitable esters include but are not limited to glycerin monoleate, glycerin dioleate, glycerin trioleate, dimer fatty acid copolymer with ethylene glycol polyester. Examples of suitable amides include but are not limited to reaction products of saturated, unsaturated, mixed saturated and unsaturated, and aryl substituted carboxylic acids having from 12 to 72 carbon atoms with amines selected from the group consisting of cyclic amines, alkylamines, alkanolamides, aromatic amines and mixtures thereof. A specific example of suitable amides includes but is not limited to alkanolamides of tall oil fatty acid. An example of a suitable commercially available ester and amide based friction/lubricity modifier that does not increase the sulfur level of ultra low sulfur diesel fuel beyond 15 ppm (parts per million) is (but is not limited to) MCC Lubricity 2115™ from MidContinental Chemical, Inc. (Overland Park, Kans.).

Engine Deposit Formation

Fuel injectors are designed to accurately meter fuel to the engine and to deliver it in a precise pattern of fine droplets. Because the fuel passages are small, injectors are highly sensitive to small amounts of deposits in the critical regions where the fuel is metered. These deposits formed in the injection nozzles cause changes and delays in fuel flow rate and can alter the fuel injection spray pattern, degrading driveability, decreasing power and fuel economy and increasing exhaust emissions.

Port Fuel Injector (PFI): Port fuel injector deposits form during the hot soak period after the engine has been turned off. The stationary fuel trapped in the injector tip is exposed to a higher temperature for a longer time than the fuel that flowed through the injector when the engine was running. The heat degrades the fuel, initiating deposit formation. In the absence of an effective additive, injector deposits can form quite rapidly if the base fuel is relatively unstable and if a vehicle is used predominantly for short trips.

Intake Valves and Ports: Deposits form on intake valves and ports because they operate at high temperatures in a very reactive environment whenever the engine is running. If the deposits become heavy, they reduce engine power due to the restriction of air flow and the alteration of air flow patterns within the cylinder. In some sensitive fuel-injected engines, even low levels of intake valve deposits can degrade performance Cold-start and warm-up driveability can be adversely affected increasing exhaust emissions. The magnitude of the emissions increase can be surprisingly large. This occurs because the deposits act somewhat like a sponge, momentarily absorbing then releasing fuel, which upsets the delicate air/fuel ratio, particularly during transients. This not only increases emissions leaving the engine but hurts the conversion efficiency of the catalytic converter as well. Other valve deposit problems include valve sticking due to deposits interfering with the valve stem sliding in its guide and burned valves due to severe deposits preventing the valve from seating properly.

Combustion Chamber: When a gasoline internal combustion engine is brand-new, its octane number requirement (ONR) is determined by its design and the quality of its manufacture. Generally, it will not knock when operated on gasoline with the antiknock quality prescribed by the manufacturer. However, the engine's ONR increases as combustion chamber deposits form during the first several thousand miles of operation. If the increase is large enough, the recommended gasoline may not prevent knocking or, if the vehicle is equipped with a knock sensor, the engine may experience the loss of power that accompanies knock suppression. Combustion chamber deposits increase ONR in two ways. They increase the combustion temperature both by transferring more heat to the incoming mixture and slowing the transfer of heat from the combustion gases (thermal insulation). They increase the compression ratio due to their bulk volume reducing the volume of the combustion chamber at TDC (Top Dead Center). Research has shown that precursors for combustion chamber deposits come from fuel and engine oil, and that certain fuel and engine oil components form more deposits than others. Combustion chamber deposit interference (CCDI) and combustion chamber deposit flaking (CCDF) are two other problems which occur in certain modern engine designs. CCDI is the result of physical contact between deposits on the piston top and cylinder head and is manifested as a loud, metallic banging sound when the engine is cold. CCDI is limited to engines that have been designed primarily to reduce emissions, with minimal clearance (1 millimeter or less) between some areas of the piston top and the cylinder head when the piston is at top dead center. Combustion chamber deposit flaking causes low compression pressures due to improper sealing of the valves. This problem occurs when pieces of combustion chamber deposits flake off and end up lodged between the valve face and the valve seat. Symptoms of CCDF are difficulty in starting and rough running when cold. An effective means of removing engine deposits and reducing engine deposit formation are the use of aftermarket deposit control additives. Deposit control additives are composed of a polar group that bonds to deposits and deposit precursors, and a non-polar group that dissolves in the fuel. Solvent based additive compounds can dissolve deposits that have already formed and reduce the opportunity for deposit precursors to form deposits in the future. A solvent is a liquid that dissolves a solid, liquid, or gaseous solute, resulting in a solution. The most common solvent in everyday life is water. Most other commonly used solvents are organic carbon containing chemicals. These are called organic solvents. The concentration of a solution is the amount of compound that is dissolved in a certain volume of solvent. The solubility of a solvent is the maximum amount of compound that is soluble in a certain volume of solvent at a specified temperature. Solvents and solutes can be broadly classified into polar (hydrophilic) and non-polar (lipophilic). The polarity can be measured as the dielectric constant or the dipole moment of a compound. The polarity of a solvent determines what type of compounds it is able to dissolve and with what other solvents or liquid compounds it is miscible. As a general rule, polar solvents dissolve polar compounds best and nonpolar solvents dissolve non-polar compounds best. Polar solvents can be further subdivided into polar protic solvents and polar aprotic solvents. A polar protic solvent is one that contains a O—H or N—H bond. A polar aprotic solvent is one that does not contain a O—H or N—H bond.

The effectiveness of the present invention is also believed to be related to the reduction of engine deposit formation. The comprehensive fuel additive composition of the present invention comprises a component sufficient to effectively reduce engine deposit formation namely Heavy Aromatic Naphtha, CAS No. 64742-94-5 being a complex combination of hydrocarbons obtained from distillation of aromatic streams and consisting of predominantly aromatic hydrocarbons having carbon numbers predominantly in the range of C9 through C16 and boiling in the range of approximately 165° C. to 290° C. (330° F. to 554° F.) with an effective range quantity being 0.48%-5.7408% by volume of the total volume of the said additive and a preferred "best mode" range for typical applications being 0.768%-2.612% by volume of the total volume of the said additive. At the volume percentages disclosed 2-Propanone $CH_3COCH_3$ being an organic polar aprotic solvent, also functions as an effective solvent, reducing engine deposit formation.

Bio-Contamination

The high temperatures involved in refinery processing effectively sterilize gasoline and diesel fuel. But the fuel quickly becomes contaminated with microorganisms present in air or water. These microorganisms include bacteria and fungi (yeasts and molds). Since most microorganisms require free water to grow, biogrowth is usually concentrated at the fuel-water interface, when one exists. In addition to the fuel and water, they also require certain elemental nutrients in order to grow. Of these nutrients, phosphorous is the only one whose concentration might be low enough in a fuel system to limit biogrowth. Higher ambient temperatures also favor growth. Some organisms require air to grow (aerobic), while others only grow in the absence of air (anaerobic). The time available for growth also is important. A few, or even a few thousand, organisms do not pose a problem. Only when the colony has had time to grow much larger will it have produced enough acidic by-product to accelerate tank corrosion or enough micribiol biomass to plug filters. Although growth can occur in working fuel tanks, static tanks where fuel is being stored for an extended period of time are a much better growth environment when water is present. Biocides can be used when microorganisms reach problem levels. The best choice is an additive that dissolves in both the fuel and the water so it can attack the microbes in both phases. The effectiveness of the present invention is also believed to be related to the reduction of fuel bio-contamination. The comprehensive fuel additive composition of the present invention comprises a component sufficient to effectively reduce fuel bio-contamination namely 1,2,4-Trimethylbenzene $C_6H_5(CH_3)_3$ or alternatively Trimethylbenzene $C_6H_3(CH_3)_3$. The effective range quantity being 0.2352%-0.9408% by volume of the total volume of the said additive and a preferred "best mode" range for typical applications being 0.384%-0.4312% by volume of the total volume of the said additive.

The comprehensive fuel additive composition of the present invention comprises an effective carrier solvent component namely Naphthalene $C_{10}H_8$ with an effective range quantity being 0.1344%-0.768% by volume of the total volume of the said additive and a preferred "best mode" range for typical applications being 0.2464%-0.384% by volume of the total volume of the said additive.

The comprehensive fuel additive composition of the present invention further comprises an effective carrier solvent componant namely Hydrotreated Light Petroleum Distillates, CAS No. 64742-47-8 being a complex combination of hydrocarbons obtained by treating a petroleum fraction with hydrogen in the presence of a catalyst and consisting of hydrocarbons having carbon numbers predominantly in the range of C9 through C16 and boiling in the range of approximately 150° C. to 290° C. (302° F. to 554° F.). As a suitable carrier solvent for diesel fuel applications the effective range quantity is 1.44%-4.608% by volume of the total volume of the said additive and a preferred "best mode" quantity for typical diesel fuel applications being 2.304% by volume of the total volume of the said additive.

The comprehensive fuel additive composition of the present invention also comprises an effective diluent component namely Hydrotreated Middle Naphthenic Petroleum Distillates, CAS No. 64742-46-7 being a complex combination of hydrocarbons obtained by treating a petroleum fraction with hydrogen in the presence of a catalyst and consisting of hydrocarbons having carbon numbers predominantly in the range of C11 through C25 and boiling in the range of approximately 205° C. to 400° C. (401° F. to 752° F.) with an effective range quantity being 0%-22.28% by volume of the total volume of the said additive and a preferred "best mode" range for typical applications being 0%-10.78% by volume of the total volume of the said additive.

The comprehensive fuel additive composition of the present invention comprises a component sufficient to effectively reduce the fuel additive composition's mal-odor namely an Aliphatic Aldehyde Aroma Compound with an effective range quantity being 0.34%-0.70% by volume of the total volume of the said additive and a preferred "best mode" range for typical applications being 0.42%-0.68% by volume of the total volume of the said additive. An example of a suitable aliphatic aldehyde is n-Hexanal ($CH_3(CH_2)_4CHO$). Alternatively an alcohol based aroma compound may be used such as 1-Hexanol $CH_3(CH_2)_5OH$.

The effectiveness of the present invention is also related to the low sulfur content of the comprehensive fuel additive composition of the present invention. When combined with ultra low sulfur diesel fuel the total sulfur level of the fuel additive composition and diesel fuel mixture does not exceed 15 ppm allowing federal ultra low sulfur diesel fuel requirements to be met.

Those of ordinary skill in the present art will understand that, under appropriate circumstances, such as cost, availability, convenience, and the precise needs of the fuel to be treated the volume percent of the disclosed components will be varied within the stated limits to meet the unique needs of the local gasoline and/or diesel fuel.

Preferably, the comprehensive fuel additive of the present invention is added to gasoline in a ratio of between 2.5 to 4 liquid ounces of fuel additive to 10 gallons of gasoline or diesel fuel. Upon reading of the specification, those skilled in the present art will understand that under appropriate circumstances, such as cost, availability, convenience and precise needs of the fuel to be treated, etc., treatment ratios can be modified. One such example would be an intermittent vehicle treatment rate of "every 5th tank" of fuel.

In general, the comprehensive fuel additive composition of the present invention is prepared using conventional techniques. The comprehensive fuel additive composition of the present invention is prepared by carefully blending the disclosed liquid components until a uniform solution is obtained. Care should be taken to prevent accidental ignition of the composition due to its high flammability.

EXAMPLE 1

Gasoline (Preferred)

| % vol/vol | Chemical Component |
|---|---|
| 7.6312% | 2-Ethylhexanol $CH_3(CH_2)_3CH(CH_2CH_3)CH_2OH$ |
| 75% | 2-Propanone $CH_3COCH_3$ |
| 2.86% | Ethoxylated Amine Based Friction/Lubricity Modifier |
| 2.6312% | Heavy Aromatic Naphtha, CAS No. 64742-94-5 |
| .4312% | Trimethylbenzene $C_6H_3(CH_3)_3$ |
| .2464% | Naphthalene $C_{10}H_8$ |
| 10.78% | Hydrotreated Middle Naphthenic Petroleum Distillates, CAS No. 64742-46-7 |
| .42% | Aliphatic Aldehyde Aroma Compound |

The disclosed liquid components were blended until a uniform solution was obtained. The resulting mixture was then added to gasoline in a ratio of 4 liquid ounces of fuel additive to 10 gallons of gasoline.

EXAMPLE 2

Gasoline (High-Friction/Lubricity Modifier and High Biocide for High Friction Engines and Highly Bio-Contaminated Gasoline)

| % vol/vol | Chemical Component |
|---|---|
| 10.7408% | 2-Ethylhexanol $CH_3(CH_2)_3CH(CH_2CH_3)CH_2OH$ |
| 75% | 2-Propanone $CH_3COCH_3$ |
| 6.24% | Ethoxylated Amine Based Friction/Lubricity Modifier |
| 5.7408% | Heavy Aromatic Naphtha, CAS No. 64742-94-5 |
| .9408% | Trimethylbenzene $C_6H_3(CH_3)_3$ |
| .5376% | Naphthalene $C_{10}H_8$ |
| .46% | Hydrotreated Middle Naphthenic Petroleum Distillates, CAS No. 64742-46-7 |
| .34% | Aliphatic Aldehyde Aroma Compound |

The disclosed liquid components were blended until a uniform solution was obtained. The resulting mixture was then added to gasoline at the intermittent treatment rate of "every 5th tank" of fuel in a ratio of 4 liquid ounces of fuel additive to 10 gallons of gasoline.

EXAMPLE 3

Gasoline (Low-Friction/Lubricity Modifier and Low Biocide)

| % vol/vol | Chemical Component |
|---|---|
| 1.8127% | 2-Ethylhexanol $CH_3(CH_2)_3CH(CH_2CH_3)CH_2OH$ |
| 75% | 2-Propanone $CH_3COCH_3$ |
| 1.56% | Ethoxylated Amine Based Friction/Lubricity Modifier |
| 1.4352% | Heavy Aromatic Naphtha, CAS No. 64742-94-5 |
| .2352% | Trimethylbenzene $C_6H_3(CH_3)_3$ |
| .1344% | Naphthalene $C_{10}H_8$ |
| 19.3825% | Hydrotreated Middle Naphthenic Petroleum Distillates, CAS No. 64742-46-7 |
| .44% | Aliphatic Aldehyde Aroma Compound |

The disclosed liquid components were blended until a uniform solution was obtained. The resulting mixture was then added to gasoline in a ratio of 4 liquid ounces of fuel additive to 10 gallons of gasoline.

EXAMPLE 4

Diesel Fuel (Preferred)

| % vol/vol | Chemical Component |
|---|---|
| 11.64% | 2-Ethylhexanol $CH_3(CH_2)_3CH(CH_2CH_3)CH_2OH$ |
| 80% | 2-Propanone $CH_3COCH_3$ |
| 3.84% | Ester and Amide Based Friction/Lubricity Modifier |
| .768% | Heavy Aromatic Naphtha, CAS No. 64742-94-5 |
| .384% | 1,2,4-Trimethylbenzene $C_6H_5(CH_3)_3$ |
| .384% | Naphthalene $C_{10}H_8$ |
| 0% | Hydrotreated Middle Naphthenic Petroleum Distillates, CAS No. 64742-46-7 |
| 2.304% | Hydrotreated Light Petroleum Distillates, CAS No. 64742-47-8 |
| .68% | Aliphatic Aldehyde Aroma Compound |

The disclosed liquid components were blended until a uniform solution was obtained. The resulting mixture was then added to diesel fuel in a ratio of 2.5 liquid ounces of fuel additive to 10 gallons of diesel fuel.

EXAMPLE 5

Diesel Fuel (High-Friction/Lubricity Modifier, High Biocide for Low Lubricity and High Bio-Contaminated Diesel Fuel)

| % vol/vol | Chemical Component |
|---|---|
| 2% | 2-Ethylhexanol $CH_3(CH_2)_3CH(CH_2CH_3)CH_2OH$ |
| 80% | 2-Propanone $CH_3COCH_3$ |
| 7.68% | Ester and Amide Based Friction/Lubricity Modifier |
| 1.536% | Heavy Aromatic Naphtha, CAS No. 64742-94-5 |
| .768% | 1,2,4-Trimethylbenzene $C_6H_5(CH_3)_3$ |
| .768% | Naphthalene $C_{10}H_8$ |
| 1.94% | Hydrotreated Middle Naphthenic Petroleum Distillates, CAS No. 64742-46-7 |
| 4.608% | Hydrotreated Light Petroleum Distillates, CAS No. 64742-47-8 |
| .70% | Aliphatic Aldehyde Aroma Compound |

The disclosed liquid components were blended until a uniform solution was obtained. The resulting mixture was then added to diesel fuel at the intermittent treatment rate of "every 5th tank" of fuel in a ratio of 2.5 liquid ounces of fuel additive to 10 gallons of diesel fuel.

EXAMPLE 6

Diesel Fuel (High Cetane Level Improver for Low Cetane Level Diesel Fuel)

| % vol/vol | Chemical Component |
|---|---|
| 22.5% | 2-Ethylhexanol $CH_3(CH_2)_3CH(CH_2CH_3)CH_2OH$ |
| 50% | 2-Propanone $CH_3COCH_3$ |
| 2.4% | Ester and Amide Based Friction/Lubricity Modifier |
| .48% | Heavy Aromatic Naphtha, CAS No. 64742-94-5 |
| .24% | 1,2,4-Trimethylbenzene $C_6H_5(CH_3)_3$ |
| .24% | Naphthalene $C_{10}H_8$ |
| 22.28% | Hydrotreated Middle Naphthenic Petroleum Distillates, CAS No. 64742-46-7 |
| 1.44% | Hydrotreated Light Petroleum Distillates, CAS No. 64742-47-8 |
| .42% | Aliphatic Aldehyde Aroma Compound |

The disclosed liquid components were blended until a uniform solution was obtained. The resulting mixture was then added to diesel fuel in a ratio of 4 liquid ounces of fuel additive to 10 gallons of diesel fuel.

EXAMPLE 7

Diesel Fuel (Low Cetane Level Improver for High Cetane Level (≧CN55) Diesel Fuels)

| % vol/vol | Chemical Component |
|---|---|
| 0% | 2-Ethylhexanol $CH_3(CH_2)_3CH(CH_2CH_3)CH_2OH$ |
| 80% | 2-Propanone $CH_3COCH_3$ |

-continued

| % vol/vol | Chemical Component |
|---|---|
| 5% | Ester and Amide Based Friction/Lubricity Modifier |
| 1% | Heavy Aromatic Naphtha, CAS No. 64742-94-5 |
| .5% | 1,2,4-Trimethylbenzene $C_6H_5(CH_3)_3$ |
| .5% | Naphthalene $C_{10}H_8$ |
| 9.32% | Hydrotreated Middle Naphthenic Petroleum Distillates, CAS No. 64742-46-7 |
| 3% | Hydrotreated Light Petroleum Distillates, CAS No. 64742-47-8 |
| .68% | Aliphatic Aldehyde Aroma Compound |

The disclosed liquid components were blended until a uniform solution was obtained. The resulting mixture was then added to diesel fuel in a ratio of 2.5 liquid ounces of fuel additive to 10 gallons of diesel fuel.

Further aspects of the invention will become apparent from consideration of the provided description. Those skilled in the present art will understand and appreciate the existence of variations, combinations and equivalents of the provided description and therefore understand that other embodiments of the invention are possible and that the details of the invention can be modified in a number of respects, all without departing from the scope and spirit of the invention. The invention should therefore not be limited by the provided description, method, and examples. The provided description, method, and examples are to be regarded as illustrative in nature rather than restrictive.

What is claimed is:

1. A fuel additive, comprising:
a propanone;
a friction/lubricity modifier;
an aromatic naphtha compound;
a benzene compound;
naphthalene;
a hydrotreated petroleum distillate; and
an aliphatic aldehyde aroma compound.

2. The additive of claim 1, further comprising a hexanol.

3. The additive of claim 2, wherein the additive comprises:
between about 1.8 and 22.5 percent by volume of said hexanol;
between about 50 and 80 percent by volume of said propanone;
between about 1.5 and 7.7 percent by volume of said friction/lubricity modifier;
between about 0.4 and 5.8 percent by volume of said naphtha compound;
between about 0.23 and 0.95 percent by volume of said benzene compound;
between about 0.13 to 0.77 percent by volume of said naphthalene;
between zero and about 22.3 percent by volume of said petroleum distillates; and
between about 0.3 and 0.7 percent by volume of said aroma compound.

4. The additive of claim 3, wherein the additive comprises:
between about 7.6 and 11.7 percent by volume of said hexanol;
between about 75 and 80 percent by volume of said propanone;
between about 2.8 and 3.9 percent by volume of said friction/lubricity modifier;
between about 0.7 and 2.7 percent by volume of said naphtha compound;
between about 0.3 and 0.44 percent by volume of said benzene compound;
between about 0.23 to 0.39 percent by volume of said naphthalene;

between and about 10.8 percent by volume of said petroleum distillates; and between about 0.4 and 0.7 percent by volume of said aroma compound.

5. The additive of claim 4, wherein said hexanol comprises 2-ethylhexanol, said propanone comprises 2-propanone, said friction/lubricity modifier comprises at least one friction/lubricity modifier selected from the group consisting of an ethoxylated amine based friction/lubricity modifier and an ester and amide based lubricity modifier, said naphtha compound comprises heavy aromatic naphtha, said benzene compound is at least one compound selected from the group consisting of trimethylbenzene and 1,2,4-trimethylbenzene, and said petroleum distillate comprises at least one distillate selected from the group consisting of hydrotreated light peteroleum distillates and hydrotreated middle naphthenic petroleum distillates.

6. The additive of claim 5, wherein said benzene compound is trimethylbenzene.

7. The additive of claim 5, wherein said benzene compound is 1,2,4-trimethylbenzene.

8. The additive of claim 5, wherein said petroleum distillates are hydrotreated light petroleum distillates.

9. The additive of claim 5, wherein said petroleum distillates are hydrotreated middle naphthenic petroleum distillates.

10. The additive of claim 5, wherein said friction/lubricity modifier comprises an ethoxylated amine based friction/lubricity modifier having the formula R—(OCH2CH2)n-NH, where 'R' represents the amine group and 'n' represents the number of oxyethylene groups.

11. A method of treating fuel, comprising the steps of:

preparing a fuel additive comprising a hexanol, a propanone, a friction/lubricity modifier, an aromatic naphtha compound, a benzene compound, naphthalene, a hydrotreated petroleum distillate, and an aliphatic aldehyde aroma compound; and mixing said fuel additive with said fuel.

12. The method of claim 11, wherein the step of preparing a fuel additive comprises mixing between about 1.8 and 22.5 percent by volume of said hexanol, between about 50 and 80 percent by volume of said propanone, between about 1.5 and 7.7 percent by volume of said friction/lubricity modifier, between about 0.4 and 5.8 percent by volume of said naphtha compound, between about 0.23 and 0.95 percent by volume of said benzene compound, between about 0.13 to 0.77 percent by volume of said naphthalene, between zero and about 22.3 percent by volume of said petroleum distillates; and between about 0.3 and 0.7 percent by volume of said aroma compound.

13. The method of claim 12, wherein the step of mixing said fuel additive with said fuel comprising the step of adding said fuel additive to said fuel in a ratio of between about 2 to 4 liquid ounces of said additive to about ten gallons of fuel.

14. The method of claim 13, wherein said hexanol comprises 2-ethylhexanol, said propanone comprises 2-propanone, said friction/lubricity modifier comprises at least one friction/lubricity modifier selected from the group consisting of an ethoxylated amine based friction/lubricity modifier and an ester and amide based friction/lubricity modifier, said naphtha compound comprises heavy aromatic naphtha, said benzene compound is at least one compound selected from the group consisting of trimethylbenzene and 1,2,4-trimethylbenzene, and said petroleum distillate comprises at least one distillate selected from the group consisting of hydrotreated light petroleum distillates and hydrotreated middle naphthenic petroleum distillates.

15. A fuel additive, comprising:

about 1 to 3 parts of a propanone;

about 0.06 to 0.25 parts of a friction/lubricity modifier;

about 0.004 to 0.23 parts of an aromatic naphtha compound;

about 0.006 to 0.04 parts of a benzene compound;

about 0.005 to 0.03 parts of naphthalene;

about 0.03 to 0.78 parts of hydrotreated petroleum distillates; and about 0.01 to 0.03 parts of an aliphatic aldehyde aroma compound.

16. The additive of claim 15, further comprising a diesel fuel having a cetane level above about CN55.

17. The additive of claim 15, further comprising up to about 0.56 parts hexanol.

18. The additive of claim 17, wherein said hexanol comprises 2-ethylhexanol, said propanone comprises 2-propanone, said friction/lubricity modifier comprises at least one friction/lubricity modifier selected from the group consisting of an ethoxylated amine based friction/lubricity modifier and an ester and amide based lubricity modifier, said naphtha compound comprises heavy aromatic naphtha, said benzene compound is at least one compound selected from the group consisting of trimethylbenzene and 1,2,4-trimethylbenzene, and said petroleum distillate comprises at least one distillate selected from the group consisting of hydrotreated light petroleum distillates and hydrotreated middle naphthenic petroleum distillates.

19. The additive of claim 18, further comprising fuel, wherein said additive and said fuel are present in a ratio of between about 2 to 4 liquid ounces of said additive to about ten gallons of said fuel.

20. The additive of claim 19, wherein said fuel is selected from the group consisting of gasoline and diesel fuel.

* * * * *

UNITED STATES PATENT AND TRADEMARK OFFICE

CERTIFICATE OF CORRECTION

PATENT NO. : 7,927,387 B1
APPLICATION NO. : 12/207478
DATED : April 19, 2011
INVENTOR(S) : AmoDio A. DiFilippo It is certified that error appears in the above-identified patent and that said Letters Patent is hereby corrected as shown below:

Claim 4, line 1 after the word "between" please insert the word --zero--

Signed and Sealed this
Seventh Day of June, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,927,387 B1
APPLICATION NO. : 12/207478
DATED : April 19, 2011
INVENTOR(S) : AmoDio A. DiFilippo It is certified that error appears in the above-identified patent and that said Letters Patent is hereby corrected as shown below:

Column 18, line 55 (Claim 4, line 1) after the word "between" please insert the word --zero--

This certificate supersedes the Certificate of Correction issued June 7, 2011.

Signed and Sealed this
Twelfth Day of July, 2011

David J. Kappos

David J. Kappos
*Director of the United States Patent and Trademark Office*